US005320072A

United States Patent [19]

Theiss et al.

[11] Patent Number: 5,320,072

[45] Date of Patent: Jun. 14, 1994

[54] APPARATUS FOR REMOVING SLUDGE DEPOSITS

[75] Inventors: Scott M. Theiss, Lake Lure, N.C.; Harry W. Masterton, Forest, Va.

[73] Assignee: B&W Nuclear Service Company, Lynchburg, Va.

[21] Appl. No.: 71,824

[22] Filed: Jun. 7, 1993

[51] Int. Cl.[5] ..... F22B 37/54

[52] U.S. Cl. ..... 122/382; 15/317; 122/391; 122/392; 134/167 R

[58] Field of Search ..... 122/390, 391, 392, 382, 122/379; 15/317, 318; 165/95; 134/167 R, 167 C

[56] References Cited

U.S. PATENT DOCUMENTS 2,696,016 12/1954 De Mart ..... 15/317
4,273,076 6/1981 Lahoda et al. ..... 122/382
5,729,455 7/1992 Boisture ..... 165/95

*Primary Examiner*—Edward G. Favors
*Attorney, Agent, or Firm*—Robert J. Edwards; D. Neil LaHaye

[57] ABSTRACT

An apparatus for removing sludge from the tubes and tubesheet of a steam generator. A support structure is adapted to be mounted at an access port of a steam generator. A lance tube extends from the support structure into the steam generator. A spool attached to a high pressure hose is received in the lance tube. A pinch roller assembly mounted on the support structure is used to move the cylinder through the lance tube. High pressure water flows through slots drilled in the spool and out holes in the lance tube against the tubes and tubesheet. A rocker motor causes back and forth rotation or rocking of the lance tube to create a sweeping action. The lance tube may also be adjusted axially to insure that the water streams are directed to the tube lanes.

7 Claims, 2 Drawing Sheets

APPARATUS FOR REMOVING SLUDGE DEPOSITS

BACKGROUND OF THE INVENTION

1. Field of the Invention

The present invention is generally related to equipment for cleaning steam generators and in particular to a high pressure fluid lance for cleaning sludge off the tubesheet and tubes by access to an open tube lane.

2. General Background

In nuclear power stations, steam generators such as recirculating steam generators (RSG's) are used for heat exchange purposes in the generation of steam for driving turbines. Primary fluid which is heated by the core of the nuclear reactor is lead through a collection or bundle of tubes in the RSG. A secondary fluid, generally water, which is fed into the space around the tubes receives heat from the tubes to provide a continuous steam generation cycle. Due to the constant high temperature and severe operating environment, a sludge mainly comprised of iron oxide such as magnetite builds up on the lower outer portion of the tubes and on the tube sheets that support the tube bundle. Since the sludge build up on the tube bundle and tube sheets reduces heat transfer efficiency and can cause corrosion, it is preferable that the tubes and tube sheets be cleaned periodically to remove the sludge.

Conventional RSG sludge lancing consists of the use of segmented lances, usually screwed together, that are moved into and out of the tube bundle by an externally mounted indexer. Operation of these lances requires that the lance sections be removed or added as the lances are retracted or advanced. The addition or removal of lance sections requires that the sludge lancing operation be stopped and it requires the presence of personnel in a radioactive area. Depending on the job and the number of passes required with the lance, as much as one half of the time scheduled for the operation involves adding and removing lance sections. This results in increased radiation exposure of personnel and unproductive down time of the nuclear steam supply system.

Patents related to sludge lancing-that applicants are aware of include the following.

U.S. Pat. No. 4,079,701 discloses a system for removing sludge from a steam generator wherein headers are arranged at the elevation of the sludge to be removed and a fluid lance is moved along the line between the headers.

U.S. Pat. No. 4,424,769 discloses an apparatus for the removal of sludge deposits on the tube sheet of a steam generator wherein a lance assembly is moved into and through the steam generator by a driving mechanism. Cleaning is carried out in successive sequences with different lances that direct cleaning fluid to the tube plate in different zones more and more remote from the lances.

U.S. Pat. No. 4,515,747 discloses a wheeled transporter that is pulled by cables along the tubesheet between the tube bundle and the steam generator shell. Inspection equipment or a nozzle for cleaning the tubesheet may be attached to the transporter.

U.S. Pat. No. 4,566,406 discloses a steam generator having a manifold with a plurality of nozzles for cleaning sludge from the tubesheet. The manifold is rigidly attached to the tubesheet and remains in place during normal operation of the steam generator.

U.S. Pat. No. 4,700,662 discloses a sludge lance wand for cleaning once through steam generators. A curved high pressure fluid feed tube has a plurality of feed tube extensions attached at one end and nozzles attached at a second end for directing fluid toward the tubesheet as the wand is moved through the steam generator.

U.S. Pat. No. 4,757,785 discloses a steam generator sludge removal apparatus wherein a track is assembled between the once through steam generator outer shell and circular shroud around the tube bundle. A motorized carriage driven on the track directs high pressure fluid toward the tube bundle through windows in the circular shroud.

SUMMARY OF THE INVENTION

The present invention addresses the equipment needs for cleaning steam generators in a straightforward manner. What is provided is an apparatus for removing sludge deposits from the tubes and tubesheet of a steam generator. A tubular support structure has a flange extending radially from one end for mounting at an access port on a steam generator. A tube received in the support structure extends beyond the flange into the steam generator. The tube has a plurality of holes spaced along the length of the tube that extends beyond the support structure. A spool closely received within the tube has an axial bore closed at one end and the central portion of the spool is drilled to provide slots therein. A high pressure hose is attached to one end of the spool so as to be in fluid communication with the axial bore in the spool. A drive mechanism mounted on the support structure at the end opposite the flange grips the high pressure hose to cause movement of the hose and spool through the tube. Water under pressure travels through the hose to the spool and exits the drilled slots into the tube. This water under pressure in the tube exits the holes spaced along its length and removes sludge on the tubes and tubesheet. A second drive mechanism mounted on the support structure may be used to cause back and forth rotation of the tube to cause the water jets to contact a larger area and create a sweeping action along the tubesheet toward the outer edges of the tube bundle.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
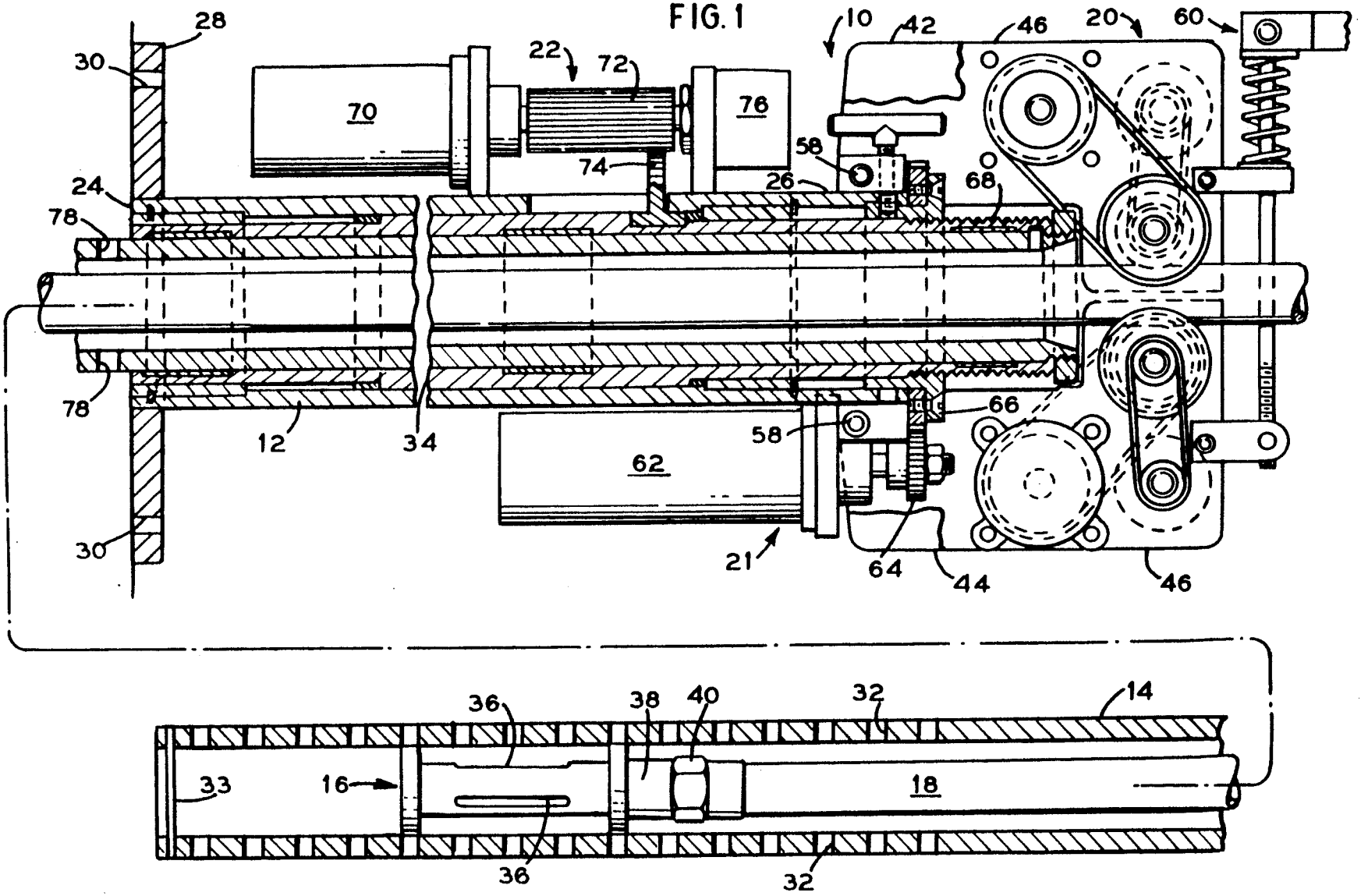
FIG. 1 is a partial cutaway side view of the invention.

Referring to the drawings, it is seen in FIG. 1 that the invention is generally indicated by the numeral 10. Sludge removal apparatus 10 is generally comprised of tubular support structure 12, lance tube 14, spool 16, high pressure hose 18, means 20 for causing spool 16 and hose 18 to move axially in lance tube 14, means 21 for axially adjusting the position of lance tube 14 in support structure 12, and means 22 for causing back and forth rotational motion or rocking of lance tube 14 in support structure 12.

As seen in FIG. 1, support structure 12 is elongated and has first and second ends 24, 26. Flange 28 extends radially from first end 24 and is provided with bores 30 therethrough that are spaced to allow support structure 12 to be bolted to an access port of a steam generator such as a manway or manhole. This allows the portion of lance tube 14 that extends beyond first end 24 to be positioned between tube rows in the steam generator.

Lance tube 14 is movably received in support structure 12 to allow axial adjustment of the position of lance tube 14 relative to support structure 12 and the tubes inside a steam generator and to allow for a back and forth rotating or rocking motion of lance tube 14 during sludge removal operations. The portion of lance tube 14 that is housed within support structure 12 has an elongated collar 34 attached thereto that cooperates with axial adjustment means 21 and rotation means 22 to cause such movement of lance tube 14. The portion of lance tube 14 that extends beyond first end 24 of support structure 12 is provided with a plurality of holes 32 that are spaced apart approximately one hundred eighty degrees around the circumference of lance tube 14. The spacing of holes 32 along the length of lance tube 14 corresponds to the pitch of spacing of the tubes in the steam generator to be cleaned. Roll pin 33 is provided through the end of lance tube 14 to prevent spool 16 from exiting lance tube 14.

Spool 16 has its ends sized to provide a close tolerance fit within lance tube 14, approximately 0.0003 inch, while still allowing movement therethrough. The central portion of spool has a reduced diameter that is drilled to provide three slots 36 spaced one hundred twenty degrees apart. Spool 16 has an axial bore that is closed at one end. The open end 38 is adapted to receive connector 40 on high pressure hose 18. This places the axial bore and holes 36 in cylinder 16 in fluid communication:: with high pressure hose 18.

Hose 18 is any suitable high pressure hose capable of delivering liquid under pressure to cylinder 16 and is connected at one end to a high pressure liquid source not shown.

Figure 2:
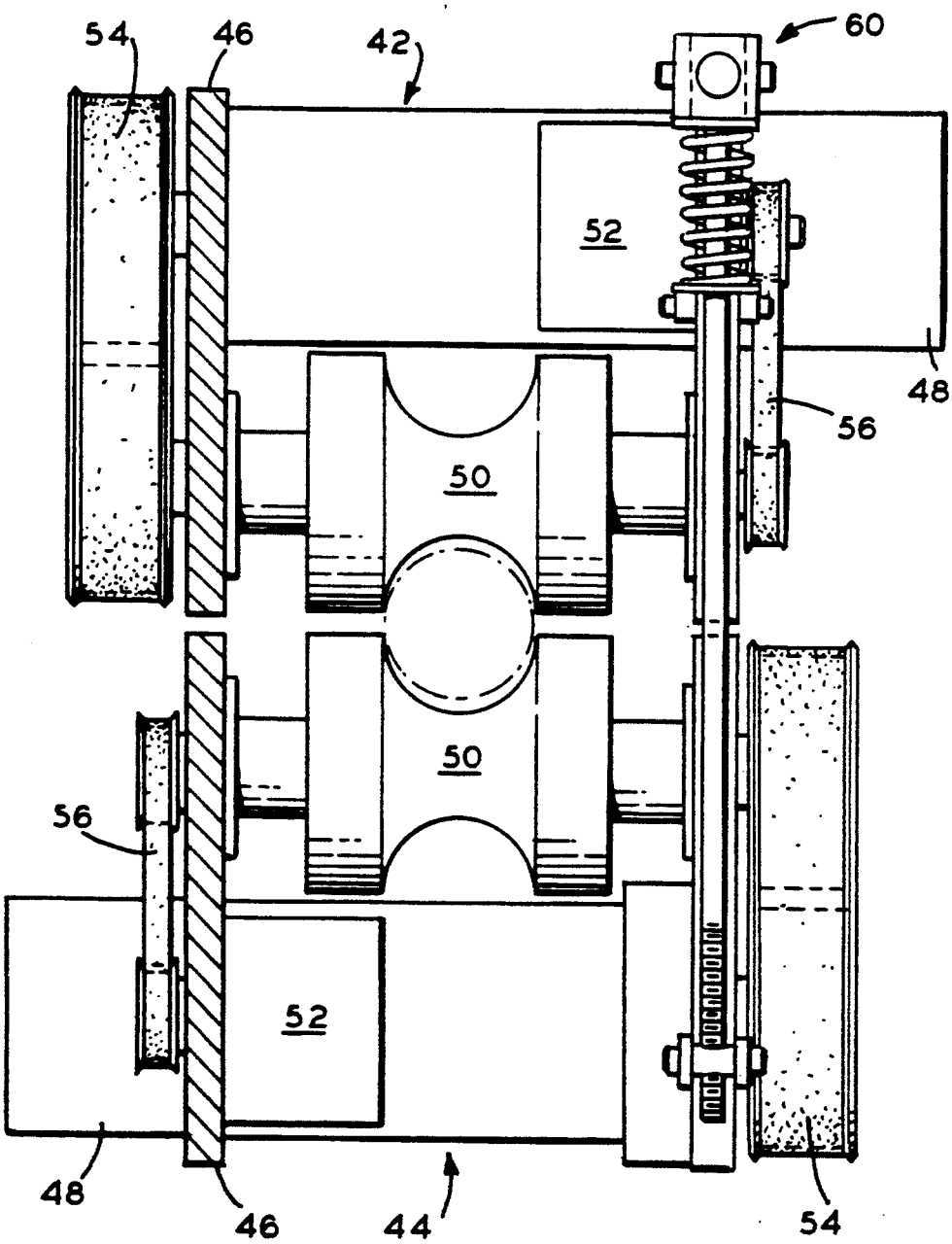
FIG. 2 is an end view of the invention.

Means 20 for causing axial movement of spool 16 and hose 18 in lance tube 14 is generally comprised of a dual gear motor driven pinch roller assembly 42, 44. As best seen in FIG. 2, assemblies 42, 44 are each formed from a frame 46, drive motor 48, pinch roller 50, position encoder 52, pinch roller drive belt 54, and position encoder drive belt 56. Assemblies 42, 44 are spaced apart one hundred eighty degrees apart around support structure 12 so that pinch rollers 50 are in opposing positions. Both pinch roller assemblies 42,44 are hingedly mounted on support structure 12 as indicated at numeral 58. This allows pinch roller assemblies 42,44 to be pivoted away from support structure 12 to allow insertion or removal of spool 16 and hose 18. Clamp 60 is used to hold first pinch roller assembly 42 in its operational position adjacent second assembly 44 to provide pressure of pinch rollers 50 on hose 18 during cleaning operations. Any suitable clamping means may be used to insure that the proper pressure is maintained on hose 18.

Means 21 for axially adjusting the position of lance tube 14 is provided in the form of alignment drive motor 62, pinion gear 64, and adjustment ring 66. Rotation of pinion gear 64 causes corresponding rotation of adjustment ring 66. Adjustment ring 66 is threadably engaged with threaded area 68 on elongated collar 34. Rotation of adjustment ring 66 thus causes axial movement of collar 34 and lance tube 14.

Means 22 for causing back and forth rotational or rocking motion of lance tube 14 is comprised of rocker motor 70, pinion gear 72, sector gear 74, and rocker position encoder 76. Rocker motor 70 is mounted on support structure 12 and drives pinion gear 72 which engages and drives sector gear 74. Sector gear 74 has its base attached to collar 34 for causing corresponding movement of lance tube 14. Rocker position encoder 76 is mounted on support structure 12 and driven by pinion gear 72 for indicating the relative radial position of holes 32 in lance tube 14.

In operation, lance tube 14 is formed from one or more sections threaded together to provide a lance tube that spans either the radius or the full diameter of the steam generator. Lance tube 14 is inserted in the access hole and support structure 12 is bolted to the steam generator. Pinch roller assemblies 42,44 are separated and spool 16 is inserted into lance tube 14. Hose 18 is used to manually push spool 16 to approximately the first set of holes 32 in lance tube 14. Pinch roller assemblies 42,44 are closed and locked on hose 18. High pressure water flow into hose 18 is then started and axial adjustment means 21 is used to move lance tube 14 so that holes 32 are aligned with the lanes between the tubes in the steam generator. Rocker position encoder 76 is used to verify the correct rocking action. Spool 16 is driven to the end of lance tube 14 by pinch roller assemblies 42, 44, the function of position encoders 52 is verified, and the counter is zeroed. Lancing can now begin without the need for personnel to return to the steam generator for all six passes of spool 16 up and down lance tube 14. The rocking action sweeps the impact point of the water along the tubesheet into the annulus and to the suctions at the outer edge of the bundle. At the end of each pass spool 16 is aligned with annulus wash holes 78 in lance tube 14. This dumps the entire water flow into the annulus in both directions to provide a direct flow for cleansing the annulus.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is Claimed as Invention is:

1. An apparatus for removing sludge deposits from the tubes and tubesheet of a steam generator, comprising:

a. a tubular support structure having a first end and a second end with a flange extending radially from the first end thereof;

b. a lance tube movably received in said support structure and extending beyond the first end of said support structure, said tube having a plurality of holes spaced along the length of said tube that extends beyond said support structure;

c. a spool closely received in said tube for axial movement in said tube, said spool having an axial bore closed at one end with the central portion of said spool being drilled;

d. a high pressure hose attached to one end of said spool so as to be in fluid communication with the bore in said spool, said hose extending through the second end of said support structure; and e. means attached to said support structure for causing axial movement of said spool and said hose in said lance tube.

2. The apparatus of claim 1, wherein said means for causing axial movement of said spool and hose comprises a pinch roller assembly mounted on said support structure.

3. The apparatus of claim 1, further comprising means for causing back and forth rotational motion of said lance tube within said support structure.

4. The apparatus of claim 1, further comprising means for axially adjusting the position of said lance tube in said support structure.

5. An apparatus for removing sludge deposits from the tubes and tubesheet of a steam generator, comprising:

a. a tubular support structure having a first end and a second end with a flange extending radially from the first end thereof;

b. a lance tube movably received in said support structure and extending beyond the first end of said support structure, said tube having a plurality of holes spaced along the length of said tube that extends beyond said support structure;

c. a spool closely received in said tube for axial movement in said tube, said spool having an axial bore closed at one end with the central portion of said spool being drilled;

d. a high pressure hose attached to one end of said spool so as to be in fluid communication with the bore in said spool, said hose extending through the second end of said support structure;

e. means attached to said support structure for causing axial movement of said spool and said hose in said lance tube comprising a pinch roller assembly mounted on said support structure; and f. means for causing back and forth rotational motion of said lance tube within said support structure.

6. The apparatus of claim 5, further comprising means for axially adjusting the position of said lance tube in said support structure.

7. The apparatus of claim 5, further comprising means for determining the axial position of said spool in said lance tube.

* * * * *